US012276421B2

(12) United States Patent
Hasegawa et al.

(10) Patent No.: US 12,276,421 B2
(45) Date of Patent: Apr. 15, 2025

(54) COLLECTIVE EXHAUST SYSTEM

(71) Applicant: NORITZ CORPORATION, Hyogo (JP)

(72) Inventors: Takahide Hasegawa, Kakogawa (JP); Atsushi Ushio, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 416 days.

(21) Appl. No.: 17/844,690

(22) Filed: Jun. 20, 2022

(65) Prior Publication Data

US 2022/0412558 A1 Dec. 29, 2022

(30) Foreign Application Priority Data

Jun. 23, 2021 (JP) ..... 2021-103863

(51) Int. Cl.
*F23N 5/24* (2006.01)

(52) U.S. Cl.
CPC ..... *F23N 5/245* (2013.01); *F23N 2225/10* (2020.01); *F23N 2225/20* (2020.01); *F23N 2233/06* (2020.01); *F23N 2235/04* (2020.01); *F23N 2241/04* (2020.01)

(58) Field of Classification Search
CPC .. F23N 2225/10; F23N 2225/20; F23N 5/245; F23N 2233/06; F23N 2235/04; F23N 2241/04
USPC ..... 431/13; 454/359
See application file for complete search history.

(56) References Cited

U.S. PATENT DOCUMENTS 9,097,436 B1 * 8/2015 Smelcer ..... F24H 1/287
2016/0123585 A1 * 5/2016 Okamoto ..... F23N 3/082 126/307 A

FOREIGN PATENT DOCUMENTS

JP H10300206 11/1998

* cited by examiner

*Primary Examiner* — Vivek K Shirsat
(74) *Attorney, Agent, or Firm* — JCIPRNET

(57) ABSTRACT

The disclosure provides a collective exhaust system capable of safely detecting a closing failure of a check valve of the collective exhaust system. The collective exhaust system includes: multiple combustion devices including blowing parts and exhaust pipes; a collective exhaust duct to which the exhaust pipes of the multiple combustion devices are respectively connected; and check valves respectively provided between the exhaust pipes and the collective exhaust duct. The collective exhaust system is configured to detect a closing failure of the check valves by performing, in a state where one of the blowing parts of the multiple combustion devices is stopped and all the other blowing parts are driven with a predetermined blower capacity, a backflow determination from the collective exhaust duct to the combustion device with the stopped blowing part, and by performing the backflow determination for the multiple combustion devices.

4 Claims, 3 Drawing Sheets

COLLECTIVE EXHAUST SYSTEM

CROSS REFERENCE TO RELATED APPLICATIONS

The present invention claims priority under 35 U.S.C. § 119 to Japanese Application No. 2021-103863 filed on Jun. 23, 2021 the entire content of which is incorporated herein by reference.

BACKGROUND

Technical Field

The disclosure relates to a collective exhaust system for collectively discharging exhaust from multiple combustion devices, and more particularly to a collective exhaust system for detecting a closing failure of a check valve for preventing backflow of exhaust to the combustion devices.

Description of Related Art

Conventionally, for example, in a bathing facility or the like having multiple hot water taps, a hot water supply system configured by multiple hot water supply devices has been used. This hot water supply system supplies hot water by the number of operating units according to the amount of hot water supply. Each hot water supply device has a combustion device equipped with a blower fan that blows combustion air, and heats hot water using the combustion heat of the combustion device. The exhaust discharged from the exhaust pipe of the combustion device is collected in the collective exhaust duct and discharged to the outside collectively.

For the connection between the exhaust pipe of each combustion device and the collective exhaust duct, an exhaust adapter including a check valve for preventing backflow of exhaust from the collective exhaust duct to the combustion device is used. When this check valve is in a state of closing failure that cannot be closed due to being stuck or the like, during non-combustion of the combustion device on the upstream side of the exhaust of the check valve with closing failure, the exhaust of other combustion devices may flow back into this non-combustion combustion device through the collective exhaust duct and diffuse to the surroundings. Therefore, it is necessary to detect an abnormality in the check valve.

For example, Patent Literature 1 discloses a technology to detect blockage of the air supply and exhaust passage of a hot water supply device by comparing the power consumption of the blower fan during the combustion of the combustion device and the power consumption when the blower fan is driven during non-combustion in a trial run of the hot water supply device.

RELATED ART

Patent Literature

[Patent Literature 1] Japanese Patent Laid-open Publication No. H10-300206.

SUMMARY

Technical Problem

By using the technique of Patent Literature 1, it is possible to detect a check valve stuck in a closed state. However, it is not possible to detect a closing failure in which the check valve cannot be closed. In addition, when constructing a collective exhaust system, clean water and fuel may not be available yet, and it is not possible to detect closing failure of the check valve by performing combustion. Further, even if it is possible to perform combustion, there is a danger that the exhaust will flow back since there may in fact be a closing failure of the check valve.

The disclosure provides a collective exhaust system capable of safely detecting a closing failure of a check valve of the collective exhaust system.

Solution to Problem

A collective exhaust system according to a first aspect of the disclosure includes: multiple combustion devices including blowing parts and exhaust pipes; a collective exhaust duct to which the exhaust pipes of the multiple combustion devices are respectively connected; and check valves respectively provided between the exhaust pipes and the collective exhaust duct. The collective exhaust system is configured to detect a closing failure of the check valves by performing, in a state where one of the blowing parts of the multiple combustion devices is stopped and all the other blowing parts are driven with a predetermined blower capacity, a backflow determination from the collective exhaust duct to the combustion device with the stopped blowing part, and by performing the backflow determination for the multiple combustion devices.

According to the above configuration, the non-combustion blowing state is set except for one of the multiple combustion devices, and the backflow determination is performed for the combustion device that is not in the blowing state, and this backflow determination is performed for the multiple combustion devices. As a result, the closing failure of the check valves that prevent the backflow of the exhaust from the collective exhaust duct, which collects the exhaust of the multiple combustion devices and discharges the exhaust collectively, to the combustion devices may be safely detected in the non-combustion blowing state.

In the collective exhaust system according to a second aspect of the disclosure, further to the first aspect of the disclosure, the backflow determination is performed based on a change in a detection temperature of a temperature detection part provided in an air supply and exhaust passage of the combustion device from the blowing part to the exhaust pipe.

According to the above configuration, if the detection temperature of the temperature detection part changes even when the blowing part is stopped, the cause of the change in the detection temperature is that the air blown from the other combustion devices flows back through the collective exhaust duct; therefore, the closing failure of the check valve may be detected.

In the collective exhaust system according to a third aspect of the disclosure, further to the first aspect of the disclosure, the backflow determination is performed based on a detection rotation speed of a rotation speed detection part that detects a rotation speed of the blowing part.

According to the above configuration, if the rotation speed detection part detects the rotation speed of the blowing part even when the blowing part is stopped, the cause is that the air blown from the other combustion devices flows back through the collective exhaust duct to rotate the blowing part; therefore, the closing failure of the check valve may be detected.

In the collective exhaust system according to a fourth aspect of the disclosure, further to the first aspect of the disclosure, the backflow determination is performed based on a detection power of a power detection part that detects a drive power of the blowing part.

According to the above configuration, if the power detection part detects the drive power of the blowing part even when the blowing part is stopped, the cause is that the air blown from the other combustion devices flows back through the collective exhaust duct to rotate the blowing part to generate power; therefore, the closing failure of the check valve may be detected.

Effects

According to the collective exhaust system of the disclosure, a closing failure of a check valve of the collective exhaust system can be safely detected.

DESCRIPTION OF EMBODIMENTS

Hereinafter, modes for carrying out the disclosure will be described with reference to embodiments.

EMBODIMENT

First, the configuration of a collective exhaust system 1 will be described.

Figure 1:
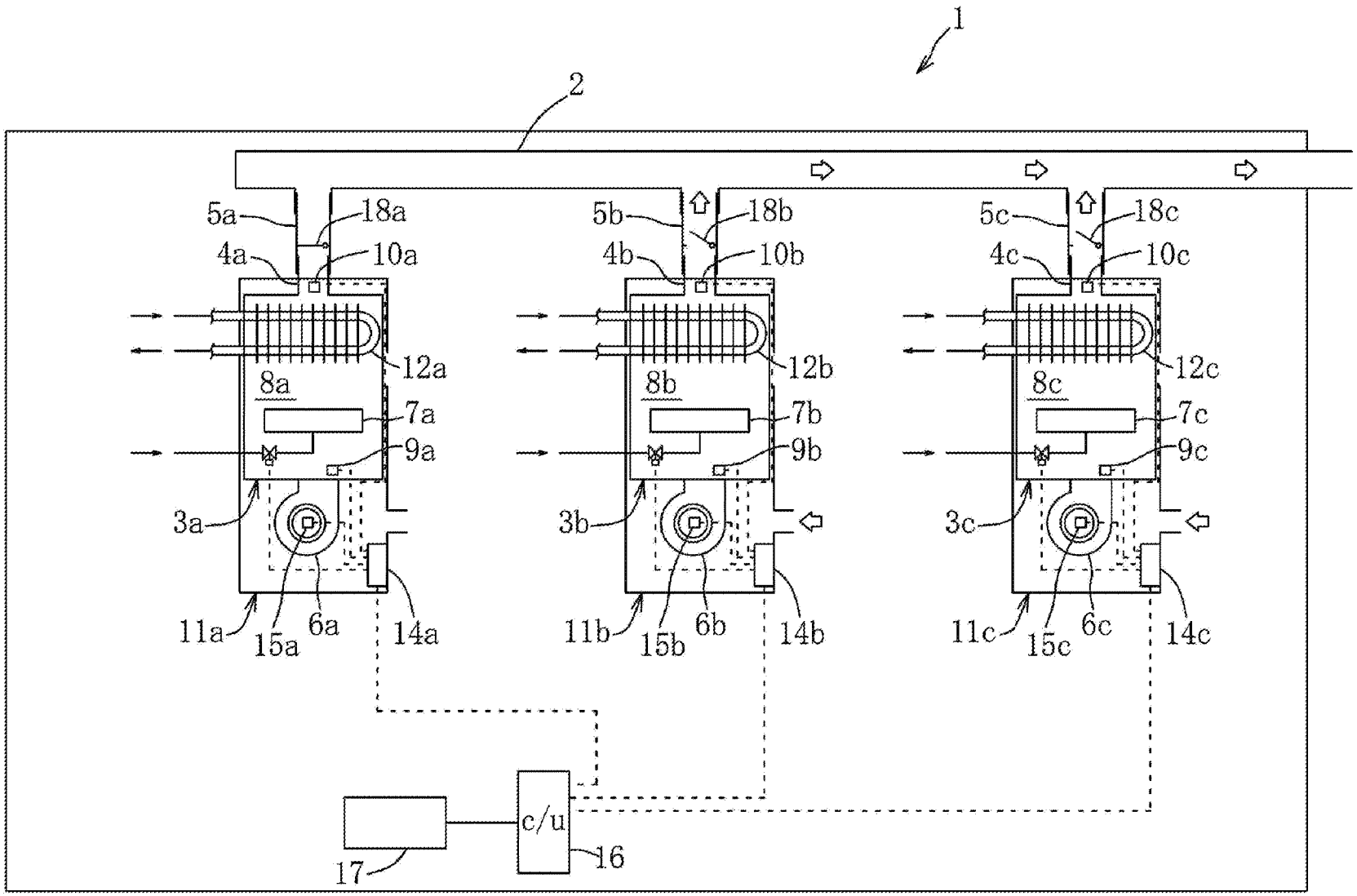
FIG. 1 is an illustration view of a collective exhaust system according to an embodiment of the disclosure.

As shown in FIG. 1, the collective exhaust system 1 includes a collective exhaust duct 2; three combustion devices 3*a* to 3*c* as multiple combustion devices, for example; and multiple exhaust adapters 5*a* to 5*c* for connecting exhaust pipes 4*a* to 4*c* of the combustion devices 3*a* to 3*c* and the collective exhaust duct 2 respectively.

For example, the combustion device 3*a* has a blower fan 6*a* which is a part for blowing air for combustion, and a burner 7*a* for burning fuel. The combustion device 3*a* is formed with an air supply and exhaust passage 8*a* from the blower fan 6*a* to the exhaust pipe 4*a* via the burner 7*a*. The supply and exhaust passage 8*a* is equipped with a supply air temperature sensor 9*a* for detecting the supply air temperature and an exhaust temperature sensor 10*a* for detecting the exhaust temperature.

The combustion device 3*a* is equipped in a hot water supply device 11*a* that heats hot water using the combustion heat, and a heat exchanger 12*a* for heating hot water by the combustion heat is provided between the burner 7*a* and the exhaust pipe 4*a*. The control part 14*a* that controls the combustion device 3*a* controls the drive of the blower fan 6*a* and the combustion of the burner 7*a* to supply hot water heated to a predetermined temperature.

The control part 14*a* controls the drive of the blower fan 6*a* by controlling the power supplied to the blower fan 6*a* based on the detection rotation speed of a rotation speed sensor 15*a* (rotation speed detection part) of the blower fan 6*a*. The control part 14*a* corresponds to the power detection part of the blower fan 6*a*. Further, the control part 14*a* adjusts the fuel supply to the burner 7*a* to control the combustion of the burner 7*a*.

Similar to the combustion device 3*a*, the other combustion devices 3*b* and 3*c* include blower fans 6*b* and 6*c*, burners 7*b* and 7*c*, air supply and exhaust passages 8*b* and 8*c*, air supply temperature sensors 9*b* and 9*c*, exhaust temperature sensors 10*b* and 10*c*, rotation speed sensors 15*b* and 15*c* (rotation speed detection parts), and the like. Further, heat exchangers 12*b* and 12*c* are respectively provided between the burners 7*b* and 7*c* and the exhaust pipes 4*b* and 4*c* in the air supply and exhaust passages 8*b* and 8*c*, and the hot water supply devices 11*b* and 11*c* are configured in this way. The control parts 14*b* and 14*c* that control the combustion devices 3*b* and 3*c* correspond to the power detection parts of the blower fans 6*b* and 6*c*.

The collective exhaust duct 2 is provided above the multiple hot water supply devices 11*a* to 11*c* so as to collect the exhaust of the multiple combustion devices 3*a* to 3*c* and discharge the exhaust to the outside collectively. The hot water supply system configured by multiple hot water supply devices 11*a* to 11*c* has a control unit 16 of the hot water supply system and an operation terminal 17 connected to the control unit 16 for performing combustion and supplying hot water by the number of operating units according to the amount of hot water supply. The control unit 16 is communicably connected to the control parts 14*a* to 14*c* of the multiple hot water supply devices 11*a* to 11*c*, transmits control signals to the combustion devices 3*a* to 3*c*, and acquires information such as the temperature of the combustion devices 3*a* to 3*c*.

The exhaust adapter 5*a* includes a check valve 18*a* that prevents the exhaust of the other combustion devices 3*b* and 3*c* from flowing back through the collective exhaust duct 2 during non-combustion of the connected combustion device 3*a*. The check valve 18*a* opens by the pressure of the exhaust of the combustion device 3*a* and closes by its own weight when there is no exhaust of the combustion device 3*a* to prevent the backflow of the exhaust. The exhaust adapters 5*b* and 5*c* are equipped with check valves 18*b* and 18*c* corresponding to the combustion devices 3*b* and 3*c* similar to this.

Next, the closing failure detection of the check valve 18*a* to 18*c* of the collective exhaust system 1 will be described.

When in one of the multiple combustion devices 3*a* to 3*c*, for example, when in the combustion device 3*a*, the blower fan 6*a* is stopped, the blower fans 6*b* and 6*c* of all of the other combustion devices 3*b* and 3*c* are driven with a predetermined blower capacity (for example, maximum capacity), and the burners 7*b* and 7*c* are driven in a non-combustion state. At this time, air flows through the air supply and exhaust passages 8*b* and 8*c* by the driven blower fans 6*b* and 6*c*, and the check valve 18*b* and 18*c* are opened by the pressure of the air, and the air flows into the collective exhaust duct 2.

In the combustion device 3*a* in which the blower fan 6*a* is stopped, since there is no air flow in the air supply and exhaust passage 8*a*, the check valve 18*a* of the combustion device 3*a* is closed, and the air does not flow back from the collective exhaust duct 2. On the other hand, when there is a closing failure of the check valve 18*a*, for example, when the check valve 18*a* is stuck in an open state, the check valve 18*a* remains open even if the blower fan 6*a* is stopped; therefore, air flows back from the collective exhaust duct 2. By the backflow determination for determining the presence or absence of this backflow, a closing failure of the check valve 18*a* of the combustion device 3*a* in which the blower fan 6*a* is stopped is detected.

Figure 2:
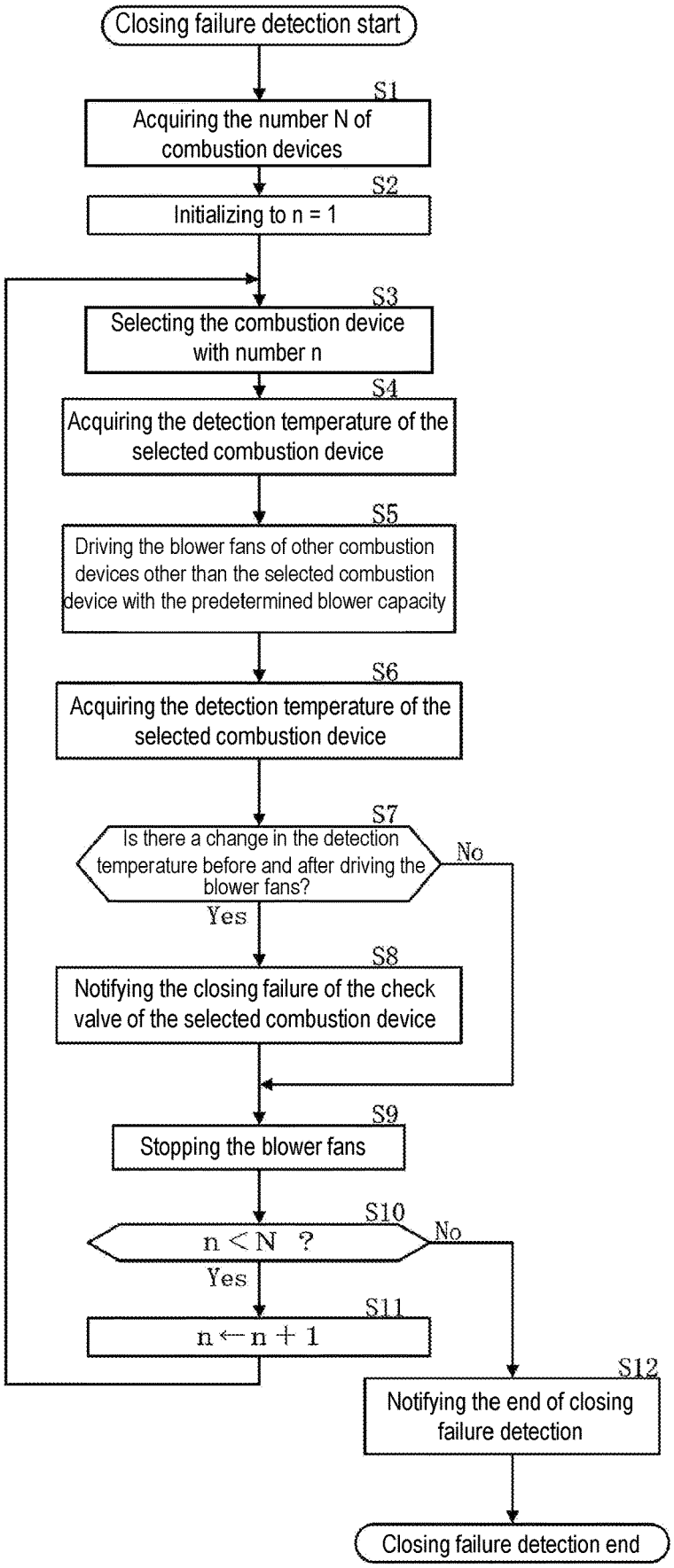
FIG. 2 is a flowchart for detecting a closing failure of a check valve of a collective exhaust system.

The combustion devices 3*a* to 3*c* are numbered in order from, for example, 1. The control unit 16 detects a closing failure of the check valves 18*a* to 18*c* of the collective exhaust system 1 by performing the backflow determination of the combustion devices 3*a* to 3*c* in a non-combustion state. This closing failure detection will be described with reference to the flowchart of FIG. 2. In the figure, Si (i=1, 2, . . . ) represents a step.

For example, when the closing failure detection is started by the operation of the operation terminal 17, in 51, the number N (here, N=3) of the combustion devices of the collective exhaust system 1 is acquired, and the process proceeds to S2. The number N of the combustion devices may be acquired, for example, by communication with the control parts 14*a* to 14*c*, and the number N of the combustion devices may be set from the operation terminal 17. In S2, the number n is initialized to 1 and the process proceeds to S3.

In S3, for example, the combustion device 3*a* with n=1 as the number n is selected, and the process proceeds to S4. Then, in S4, for example, the detection temperature of the supply air temperature sensor 9*a* of the selected combustion device 3*a* is acquired, and the process proceeds to S5.

In S5, all of the blower fans 6*b* and 6*c* of the other combustion devices 3*b* and 3*c* other than the selected combustion device 3*a* are driven with a predetermined blower capacity (for example, maximum blower capacity) at which the corresponding check valve 18*b* and 18*c* are sufficiently opened, and the process proceeds to S6. At this time, since air is blown without making the burners 7*b* and 7*c* perform combustion, air flows into the collective exhaust duct 2 from the combustion devices 3*b* and 3*c*. The pressure of the exhaust is low because there is no volume expansion due to combustion heat in non-combustion, but by driving the blower fans 6*b* and 6*c* with a large blower capacity to compensate this, the check valve 18*b* and 18*c* are opened by the pressure or air blowing.

In S6, the detection temperature of the supply air temperature sensor 9*a* of the selected combustion device 3*a* is acquired, and the process proceeds to S7. Then, in S7, the backflow determination is performed. This backflow determination is performed based on whether the detection temperature of the selected combustion device 3*a* has changed before and after driving the blower fans 6*b* and 6*c*.

For example, when the supply air temperature sensors 9*a* to 9*c* are thermistors, there is self-heating due to energization, and if the blower fans 6*a* to 6*c* are stopped and there is no flow of air, the detection temperature is stable according to the air temperature at that time. When the blower fans 6*a* to 6*c* are driven, the heat dissipation of self-heating is facilitated by the flow of air, and the detection temperature decreases (changes) with respect to the detection temperature of the thermistor when the blower fans 6*a* to 6*c* are stopped. Even when there is a backflow due to the closing failure of the check valves 18*a* to 18*c*, the backflow air facilitated heat dissipation, and the detection temperature decreases. Therefore, the backflow determination may be performed based on the change in the detection temperature. Similarly, when the exhaust temperature sensors 10*a* to 10*c* are thermistors, backflow determination may be performed based on the change in the detection temperature.

If the determination of S7 is Yes (there is a backflow), the process proceeds to S8, and in S8, the closing failure of the check valve 18*a* of the combustion device 3*a* with the number n=1 is notified, and the process proceeds to S9. On the other hand, if the determination of S7 is No (there is no backflow), the process proceeds to S9.

In S9, all the driven blower fans 6*b* and 6*c* are stopped, and the process proceeds to S10. Then, in S10, it is determined whether the number n is less than the number N of the combustion devices. If the determination of S10 is Yes, the process proceeds to S11, and the number n is incremented by 1 in S11, and the process returns to S3. On the other hand, if the determination of S10 is No (when n=N), the backflow determination of the N units of the combustion devices 3*a* to 3*c* is completed, so the process proceeds to S12, and in S12, the end of the closing failure detection is notified, and the process is ended.

By performing the backflow determination for the multiple combustion devices 3*a* to 3*c* as described above, the closing failure of the multiple check valves 18*a* to 18*c* of the collective exhaust system 1 may be detected. In this closing failure detection, since the combustion devices 3*a* to 3*c* are not performing combustion, even if there is a backflow, it may be safely detected. Further, since it is not necessary to supply hot water, even if clean water and fuel cannot be used at the time of construction of the collective exhaust system 1, it is possible to detect the closing failure of the check valves 18*a* to 18*c*.

Figure 3:
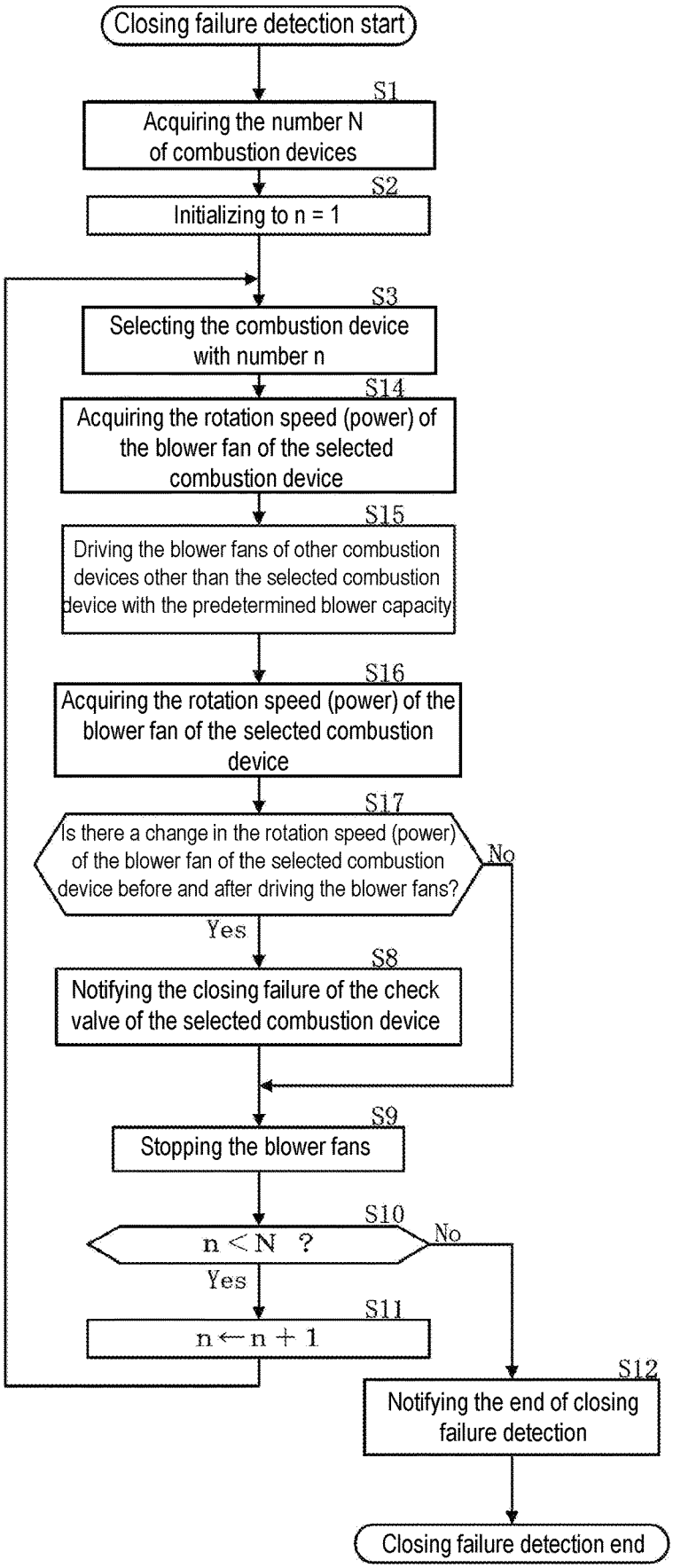
FIG. 3 is another example of a flowchart for detecting a closing failure of a check valve of a collective exhaust system.

As shown in FIG. 3, the backflow determination may also be performed based on the detection rotation speed of the rotation speed detection part for detecting the rotation speed of the blower fans 6*a* to 6*c* or the detection power of the power detection part for detecting the drive power of the blower fans 6*a* to 6*c*. 51 to S3 are the same as above. In S3, the combustion device is selected, and the process proceeds to S14, and in S14, for example, the rotation speed or the power of the blower fan 6*a* of the selected combustion device 3*a* is acquired, and the process proceeds to S15. In this case, since the blower fans 6*a* to 6*c* are not driven, the detection rotation speed or power is, for example, zero.

In S15, the blower fans 6*b* and 6*c* of the other combustion devices 3*b* and 3*c* other than the selected combustion device 3*a* are driven with a predetermined blower capacity (for example, the maximum blower capacity), and the process proceeds to S16. Then, in S16, the rotation speed or the power of the blower fan 6*a* of the selected combustion device 3*a* is acquired, and the process proceeds to S17. In S17, it is determined whether the rotation speed or the power of the blower fan 6*a* has changed before and after driving the blower fans 6*b* and 6*c*.

When there is a backflow from the collective exhaust duct 2, the blower fan 6*a* rotates due to the backflow. The rotation speed or power detected at this time may be compared with the rotation speed or power when the blower fan 6*a* is stopped to perform the backflow determination. Further, if the blower fan 6*a* rotates in a direction opposite to that at the time of blowing due to the backflow and is detected with, for example, a negative rotation speed or negative power (power generation), the backflow determination may be performed based on this rotation speed or power without comparing with the rotation speed or the power at the time of stopping. After the backflow determination in S17, the process is the same as in FIG. 2 above, so the description thereof will be omitted.

The operation and effect of the above-described collective exhaust system 1 will be described.

The non-combustion blowing state is set except for one of the multiple combustion devices 3*a* to 3*c*, and the backflow determination is performed for the combustion device that is not in the blowing state, and this backflow determination is performed for the multiple combustion devices 3*a* to 3*c*. As a result, the closing failure of the check valves 18*a* to 18*c* that prevent the backflow of the exhaust from the collective exhaust duct 2, which collects the exhaust of the multiple combustion devices 3*a* to 3*c* and discharges the exhaust collectively, to the combustion devices 3*a* to 3*c* may be safely detected in the non-combustion blowing state.

The backflow determination is performed based on the change in the detection temperature of the temperature detection parts (supply air temperature sensors 9*a* to 9*c* or exhaust temperature sensors 10*a* to 10*c*) provided in the air supply and exhaust passages 8*a* to 8*c* of the combustion devices 3*a* to 3*c* from the blower fans 6*a* to 6*c* to the exhaust pipes 4*a* to 4*c*. For example, if the detection temperature of the air supply temperature sensor 9*a* changes even when the blower fan 6*a* is stopped, the cause of the change in the detection temperature is that the air blown from the other combustion devices 3*b* and 3*c* flows back through the collective exhaust duct 2; therefore, the closing failure of the check valve 18*a* may be detected.

The backflow determination may be performed based on the detection rotation speed of the rotation speed detection part that detects the rotation speed of the blower fans 6*a* to 6*c*. For example, if the rotation speed detection part detects the rotation speed of the blower fan 6*a* even when the blower fan 6*a* is stopped, the cause is that the air blown from the other combustion devices 3*b* and 3*c* flows back through the collective exhaust duct 2 to rotate the blower fan 6*a*; therefore, the closing failure of the check valve 18*a* may be detected.

The backflow determination may be performed based on the detection power of the power detection part that detects the drive power of the blower fans 6*a* to 6*c*. For example, if the power detection part detects the drive power of the blower fan 6*a* even when the blower fan 6*a* is stopped, the cause is that the air blown from the other combustion devices 3*b* and 3*c* flows back through the collective exhaust duct 2 to rotate the blower fan 6*a* to generate power; therefore, the closing failure of the check valve 18*a* may be detected.

The detection temperature and the like in the state where the blower fans 6*a* to 6*c* of the multiple combustion devices 3*a* to 3*c* are stopped may be stored in advance, and one of the blower fans 6*a* to 6*c* may be stopped from the state where all the blower fans 6*a* to 6*c* are driven to perform a backflow determination; by performing this backflow determination on multiple combustion devices 3*a* to 3*c*, a closing failure may be detected.

In addition, a person skilled in the art can carry out the embodiments in forms in which various modifications are added to the above embodiments without departing from the spirit of the disclosure, and the disclosure includes such modified embodiments.

What is claimed is:

1. A collective exhaust system comprising:

a plurality of combustion devices comprising blowing parts and exhaust pipes;

a collective exhaust duct to which the exhaust pipes of the plurality of combustion devices are respectively connected; and check valves respectively provided between the exhaust pipes and the collective exhaust duct, wherein the collective exhaust system is configured to detect a closing failure of the check valves by performing, in a non-combustion state where one of the blowing parts of the plurality of combustion devices is stopped and all the other blowing parts are driven with a predetermined blower capacity, a backflow determination from the collective exhaust duct to the combustion device with the stopped blowing part, and by performing the backflow determination for the plurality of combustion devices in the non-combustion state.

2. The collective exhaust system according to claim 1, wherein the backflow determination is performed based on a change in a detection temperature of a temperature detection part provided in an air supply and exhaust passage of the combustion device from the blowing part to the exhaust pipe.

3. The collective exhaust system according to claim 1, wherein the backflow determination is performed based on a detection rotation speed of a rotation speed detection part that detects a rotation speed of the blowing part.

4. The collective exhaust system according to claim 1, wherein the backflow determination is performed based on a detection power of a power detection part that detects a drive power of the blowing part.

* * * * *